US009327161B1

(12) United States Patent
Maher et al.

(10) Patent No.: US 9,327,161 B1
(45) Date of Patent: May 3, 2016

(54) PORTABLE SPOTTING DEVICE

(71) Applicants: Paul R. Maher, Garnet Valley, PA (US); Linda Maher, Garnet Valley, PA (US)

(72) Inventors: Paul R. Maher, Garnet Valley, PA (US); Linda Maher, Garnet Valley, PA (US)

( * ) Notice: Subject to any disclaimer, the term of this patent is extended or adjusted under 35 U.S.C. 154(b) by 281 days.

(21) Appl. No.: 13/918,933

(22) Filed: Jun. 15, 2013

(51) Int. Cl.
*A63B 21/16* (2006.01)
*A63B 21/078* (2006.01)

(52) U.S. Cl.
CPC ..... *A63B 21/078* (2013.01)

(58) Field of Classification Search
CPC ..... A63B 21/078; A63B 21/1457; A63B 21/0786; A63B 2021/0783; A63B 2021/0786
See application file for complete search history.

(56) References Cited

U.S. PATENT DOCUMENTS 4,142,736 A * 3/1979 Ackerfeldt et al. ..... 280/652
4,249,726 A 2/1981 Faust
4,615,524 A 10/1986 Sutherland
4,807,875 A 2/1989 Tanski
5,058,888 A 10/1991 Walker et al.
5,151,072 A 9/1992 Cone et al.
5,314,394 A 5/1994 Ronan
5,688,216 A 11/1997 Mauriello
5,989,166 A * 11/1999 Capizzo ..... A63B 21/0783 482/1
6,086,520 A 7/2000 Rodriquez
6,558,299 B1 5/2003 Slattery
6,632,159 B1 10/2003 Slattery
6,746,379 B1 6/2004 Brawner
6,926,648 B2 8/2005 Capizzo
7,585,259 B2 9/2009 Turner
8,328,698 B1 * 12/2012 Webber et al. ..... 482/104
2003/0181296 A1 * 9/2003 Dumont ..... 482/93
2007/0072750 A1 3/2007 Andrews
2011/0172066 A1 7/2011 Roppolo

OTHER PUBLICATIONS http://www.ccohs.ca/oshanswers/safety_haz/materials_handling/hoists.html, last visited Jun. 15, 2015).*

* cited by examiner

*Primary Examiner* — Loan H Thanh
*Assistant Examiner* — Rae Fischer
(74) *Attorney, Agent, or Firm* — Invention To Patent Services; Alex Hobson

(57) ABSTRACT

A portable spotting device that can be moved by a single person from one piece of exercise equipment to another is described. The portable spotting device has a central tower having a vertical support, a powered lifting device and an actuator portion. A powered lifting device, such as an electric motor, may be coupled to the vertical support and drive a cable spool, whereby a cable is attached to the actuator portion. The electric motor, configured as a wench may move the actuator portion up and down along the vertical support. A horizontal extension attached to the actuator has a pair of adjustable arms the extend forward to retain and lift a weight, such as a weight bar. An actuator pedal allows a weight lifter to control the height of the adjustable arms while lying on a bench.

20 Claims, 12 Drawing Sheets

PORTABLE SPOTTING DEVICE

BACKGROUND OF THE INVENTION

1. Field of the Invention

The present invention relates to a portable spotting device having a powered lifting device.

2. Background

Lifting weights, such as doing bench presses, can be dangerous when conducted alone. A weight lifter may lift the bar from the rack, bring the bar down to their chest and then not be able to lift the bar back onto the rack. This causes a dangerous situation, as the weight lifter has to roll the bar down their chest and sit-up to get out from under the bar. There is also the possibility that the bar will roll up and onto the weight lifters neck possibly causing death. There exists a need for a spotting device that can be operated by the weight lifter, that is easy to use, and is portable whereby the spotting device can be easily moved from one piece of equipment to another.

There are any number of spotting devices taught in the prior art, however these devices are not portable nor are they attached to a piece of equipment.

SUMMARY OF THE INVENTION

The invention is directed to a portable spotting device comprising a central tower having a vertical support, a powered lifting device and an actuator portion coupled to and configured to move up and down along the vertical support. The powered lifting device, such as an electric motor, is coupled with the vertical support and the actuator portion, whereby the powered lifting device moves the actuator up and down. A horizontal extension is centrally coupled to the actuator portion whereby the horizontal extension is configured to move up and down along said vertical support with the actuator portion. A pair of adjustable arms are coupled to the horizontal extension and extend out from the horizontal extension away from the vertical support. The adjustable arms can be adjusted in position along the) length of the horizontal extension. The pair of adjustable arms are configured to engage a lifting bar and have a plurality stops to retain a lifting bar. An actuator pedal is coupled with the powered lifting device and allows a weight lifter to manipulate the actuator portion to move up and down. One or more wheels are coupled to the portable spotting device, such as to the base and/or to the vertical support, to allow the portable spotting device to be tilted and rolled from one location to another. The portable spotting device is configured to be moved by a single person from one location to another.

The central tower comprises a vertical support that extends up from the floor or from a base that it is attached thereto. A vertical support may have any suitable cross-sectional shape and length. In an exemplary embodiment, the vertical support is a square shaped hollow beam. The vertical support may have one or more rails for guiding the actuator portion up and down along the vertical support. The vertical support may have a front side that faces the horizontal extension, a left and right side, and a back side.

A powered lifting device may be any suitable type of powered device including an electric motor, linear actuator, a servo-motor and the like. The powered device, such as an electric motor, may be coupled to the actuator portion by a cable and one or more pulleys. A powered lifting device may be configured substantially at the top of the vertical support, or within 20% of the vertical support length from the top end, or substantially at the bottom of the vertical support, or within 20% of the vertical support length from the bottom end. In the embodiment with the powered lifting device being configured substantially at the top of the vertical support, a single cable may couple the electric motor to the actuator portion. An electric motor may drive a spool that turns to take-up or release a cable. In the embodiment with the powered lifting device being configured substantially at the bottom of the vertical support, a cable may extend up and around a pulley and then down to the actuator portion. The powered lifting device may be configured outside of an interior volume of the vertical support or at least partially with an interior volume of a vertical support. For example, the spool and cable may extend within an interior volume of a vertical support for safety reasons.

An actuator portion is configured to move up and down along the vertical support and may comprise any suitable means to move smoothly along the vertical support including a track and wheels. For example, one or more tracks may be configured along the vertical support and wheels coupled to the actuator portion may be configured to move along the tracks. A track may be a raised portion, or a recessed portion along at least a portion of the length of the vertical support. An actuator portion may have a first support on the left side of the vertical support, a second support on the right side of the vertical support, and a connecting portion between the first and second supports that extends along the front and/or back of the vertical support. In another exemplary embodiment, an actuator portion is configured to extend around the perimeter of the vertical support. For example, a vertical support may have a square cross-sectional shape and an actuator portion may also have a square cross sectional shape that is configured to fit over and around the vertical support.

A horizontal extension is coupled to the actuator portion and extends out on either side of the vertical support and is typically centrally configured with the length of extensions to sides being substantially equal. The horizontal extension may have any suitable shape, length or geometry. In an exemplary embodiment, the horizontal extension has a square or rectangular cross-sectional shape, and may be hollow or solid. The horizontal extension is configured to carry the weight of the bar and therefore should be designed appropriately to withstand suitable loads.

A pair of adjustable arms are coupled to either side of the horizontal extension and may be slid along the length of the horizontal extension to accommodate different bench widths, lifting bar configurations and the like. In an exemplary embodiment, the adjustable arms comprise a conduit at one end that fits around the horizontal extension, whereby the adjustable arms can be slid along the horizontal extension. The adjustable arms may be locked into position along the horizontal extension with any suitable device. In an exemplary embodiment, the horizontal extension comprises a plurality of locking holes configured along the horizontal extension length, whereby a set-pin affixed to the adjustable arms is configured to secure the adjustable arms to the horizontal extension.

The adjustable arms comprise a plurality of stops that may be raised portions, or depressed portions, along the length of the adjustable arms to retain a bar within a location, thereby preventing a bar retained thereon from rolling back and forth. A stop may have any suitable shape and size including triangular, square, rounded and the like. In an exemplary embodiment, a stop configured at the extended end of the adjustable arms may be spring-loaded whereby rolling a bar over the stop from the extended end toward the central tower causes the stop to depress and allow the bar to roll there over. Any of the stops may be configured as spring loaded stops that depress when a force from one side is exerted thereon.

The portable spotting device further comprises a base that is configured to effectively support the spotting device with a weighted bar retained thereon. The base is configured to support the spotting device with a bar retained within the stops at the furthest end of the adjustable arms from the vertical support. This situation will create the most torque on the spotting device. A base may therefore comprise one or more forward base portions that extend forward from the vertical support, or from a horizontal base portion. A horizontal base portion extends out from either side of the vertical support. In an exemplary embodiment, the base portion comprises a forward base portion and a horizontal base portion that intersect at the vertical support in a general T-shape.

The actuator pedal is configured with a pedal connector to the motor, whereby pressing or otherwise engaging the actuator pedal sends a signal to the motor to move. An actuator pedal may have an up and/or down pedal. A weight lifter may use the actuator to move a weight down over their chest allowing them to lift up the weight. In another embodiment, a weight lifter may move the adjustable arms down to a ready, lowered position, whereby if they cannot lift a weight up, the adjustable arms are conveniently located to allow the weight lifter to rest the bar thereon, or engage the actuator pedal to move the adjustable arms up slightly to retain the bar and lift it up off of them.

The portable spotting device of the present invention is configured to be easily moved by a single person from one location to another. In a gym, there are typically any number of weight lifting apparatus, such as benches, and weight lifters may want to move the spotting device, described herein, from one apparatus to another. One or more wheels may be configured on the base or vertical support to allow the spotting device to be tilted and rolled. A cantilevered wheel coupled to the vertical support at a raised height from the floor may further facilitate moving of the portable spotting device. A single person may tilt the portable spotting device and roll it from one location to another where they may position it as desired and tilt the portable spotting device back down.

The portable spotting device of the present invention may be designed to lift any suitable amount of weight including, but not limited to, more than about 100 lbs, more than about 200 lbs, more than about 250 lbs, more than about 300 lbs, or more than about 500 lbs.

The summary of the invention s provided as a general introduction to some of the embodiments of the invention and is not intended to be limiting. Additional example embodiments including variations and alternative configurations of the invention are provided herein.

BRIEF DESCRIPTION OF THE DRAWINGS

The accompanying drawings are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
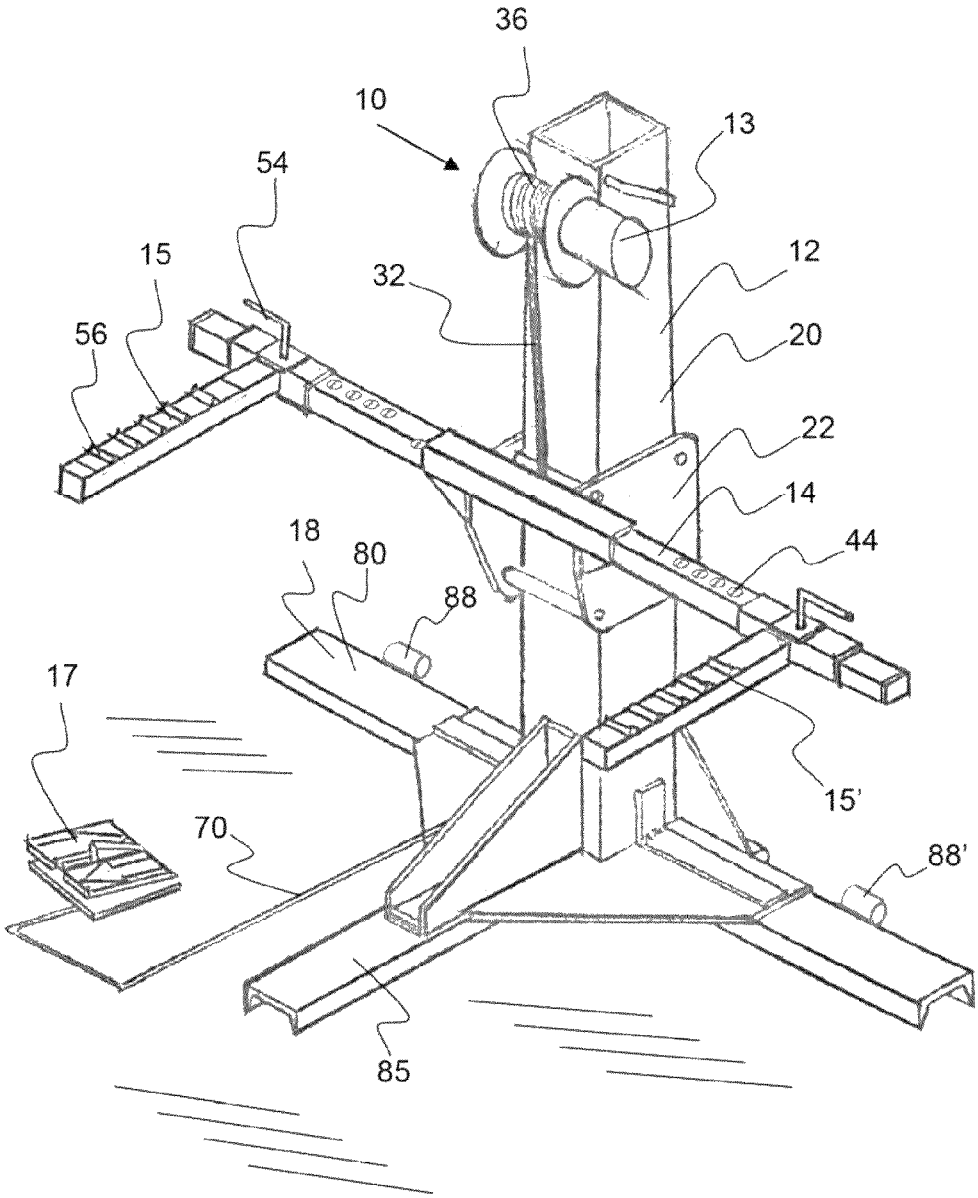

FIG. 1 shows an isometric view of an exemplary portable spotting device having a powered lifting device configured substantially at the top of the vertical support as described herein.

Figure 2:
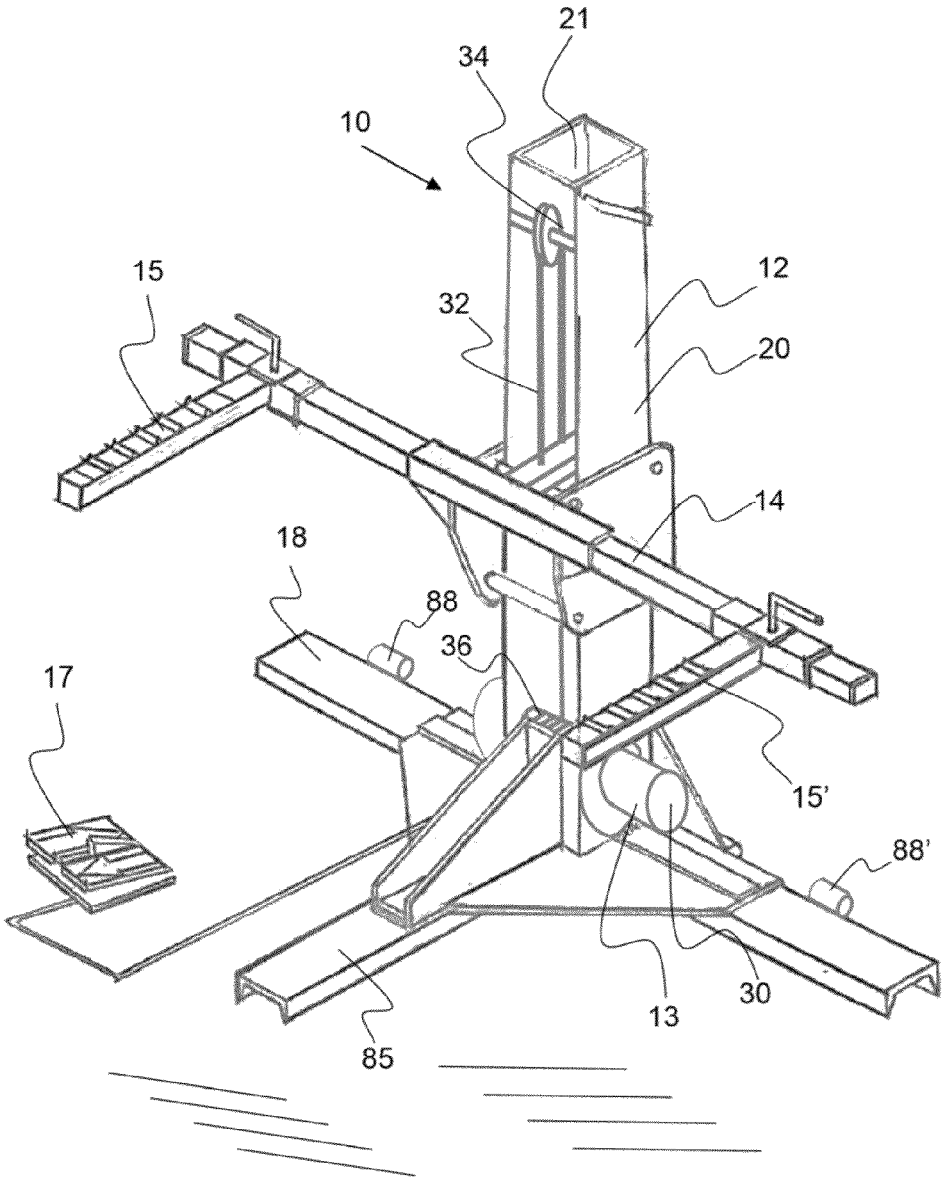

FIG. 2 shows an isometric view of an exemplary portable spotting device having a powered lifting device configured substantially at the bottom of the vertical support as described herein.

Figure 3:
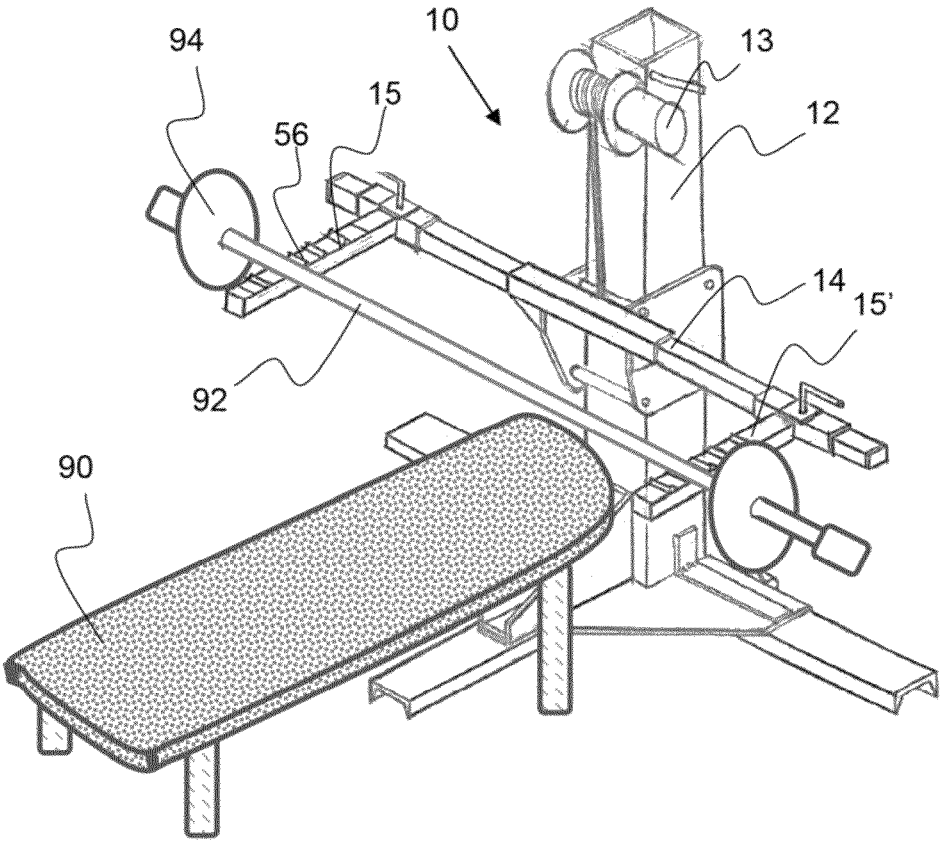

FIG. 3 shows an isometric view of an exemplary portable spotting device configured with a bench to provide a weight bar support and spotting means as described herein.

Figure 4A:
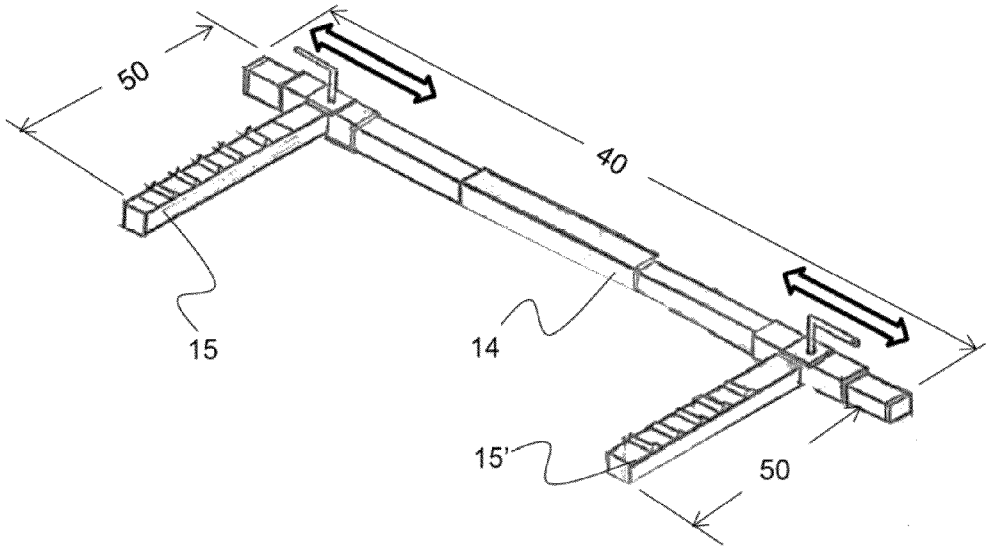

FIG. 4A shows an isometric view of a horizontal extension having two adjustable arms coupled thereto, as described herein.

Figure 4B:
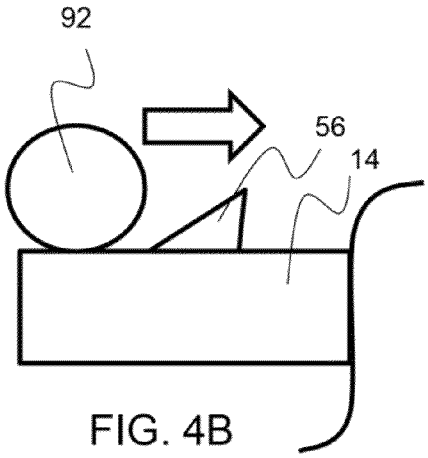
Figure 4C:
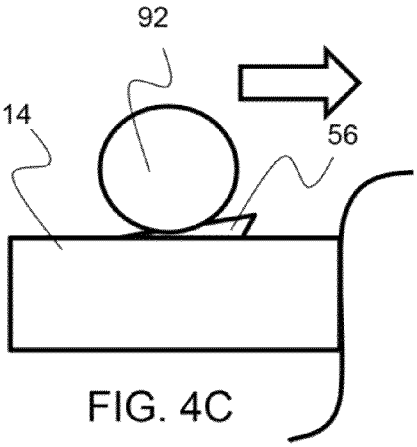

FIG. 4B and FIG. 4C show a side view of a portion of an exemplary adjustable arm having spring loaded stop depresses to allow a bar to roll there over from one side, as described herein.

Figure 5:
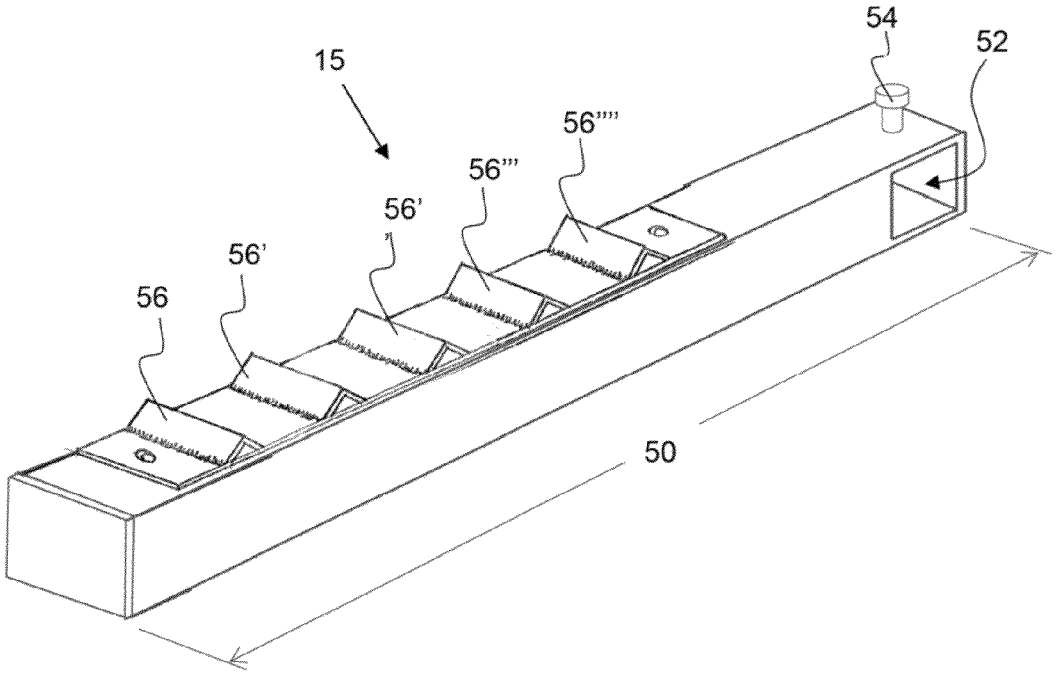

FIG. 5 shows an isometric view of an adjustable arm having a plurality of stops as described herein.

Figure 6:
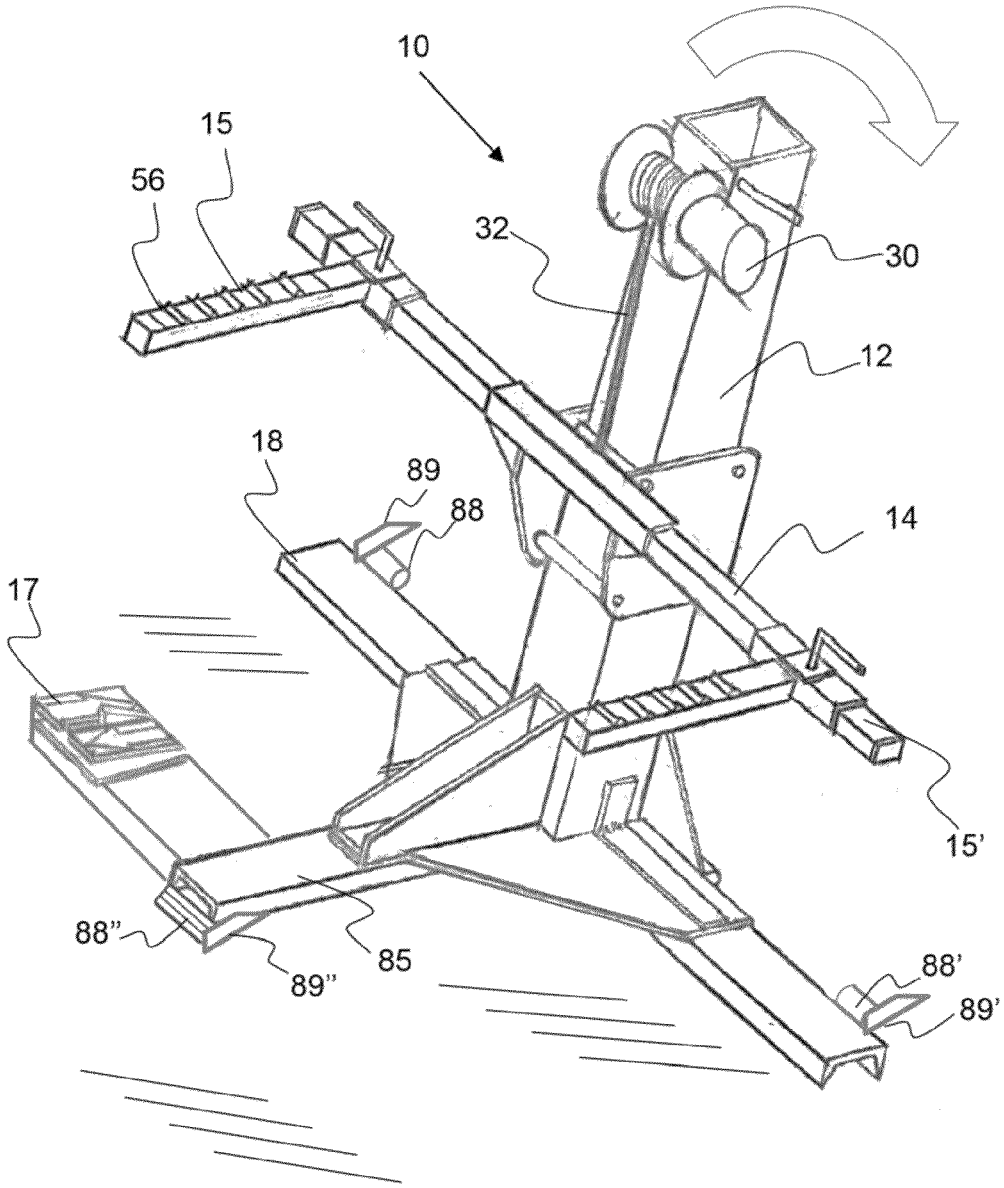

FIG. 6 shows an isometric view of an exemplary portable spotting device having a plurality of wheels attached to the base as described herein.

Figure 7:
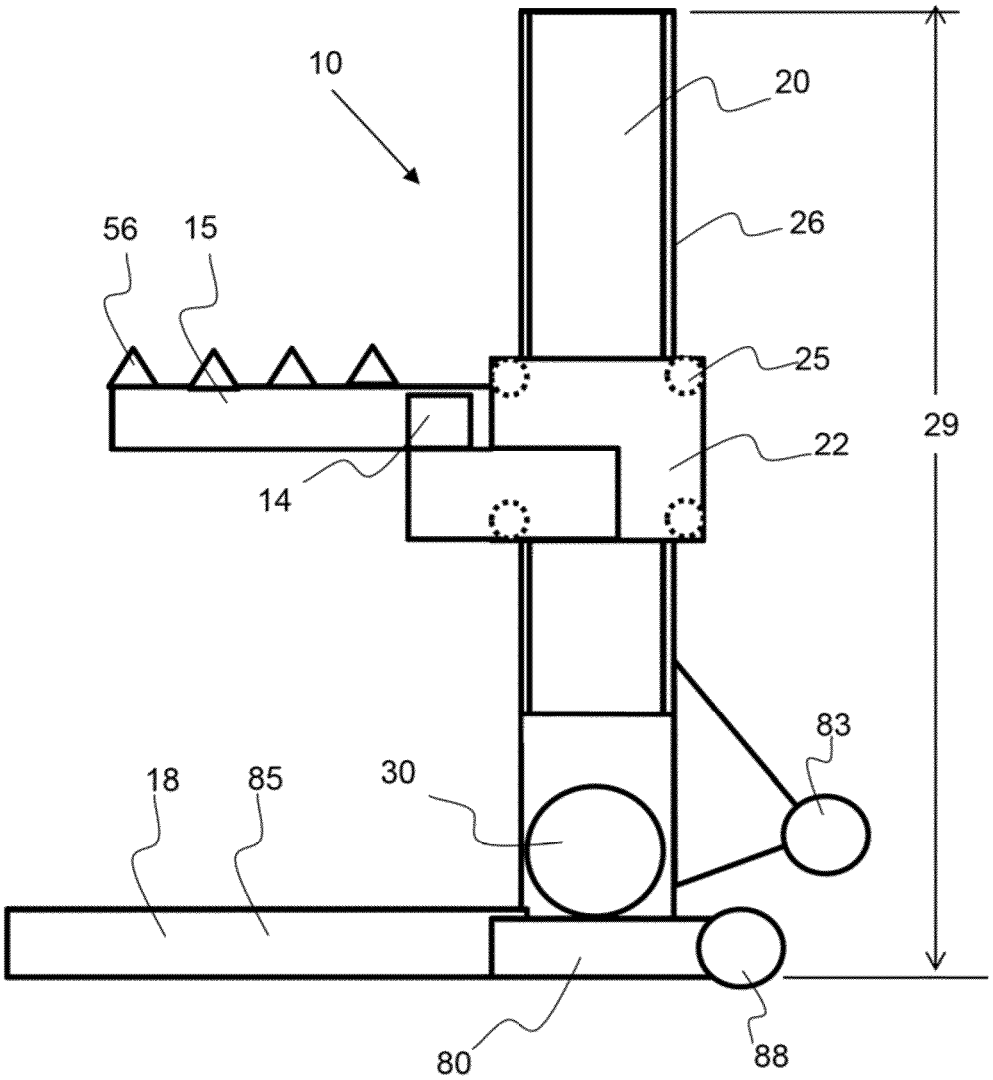

FIG. 7 shows side view of an exemplary portable spotting device having cantilevered wheel and a wheel attached to the base as described herein.

Figure 8:
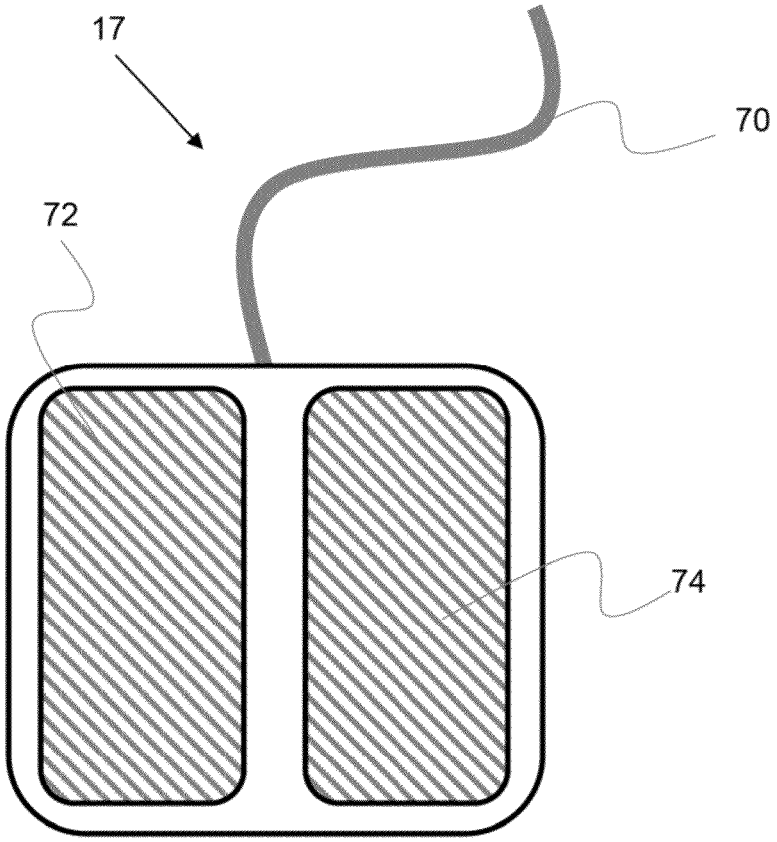

FIG. 8 shows a top down view of an actuator pedal as described herein.

Figure 9:
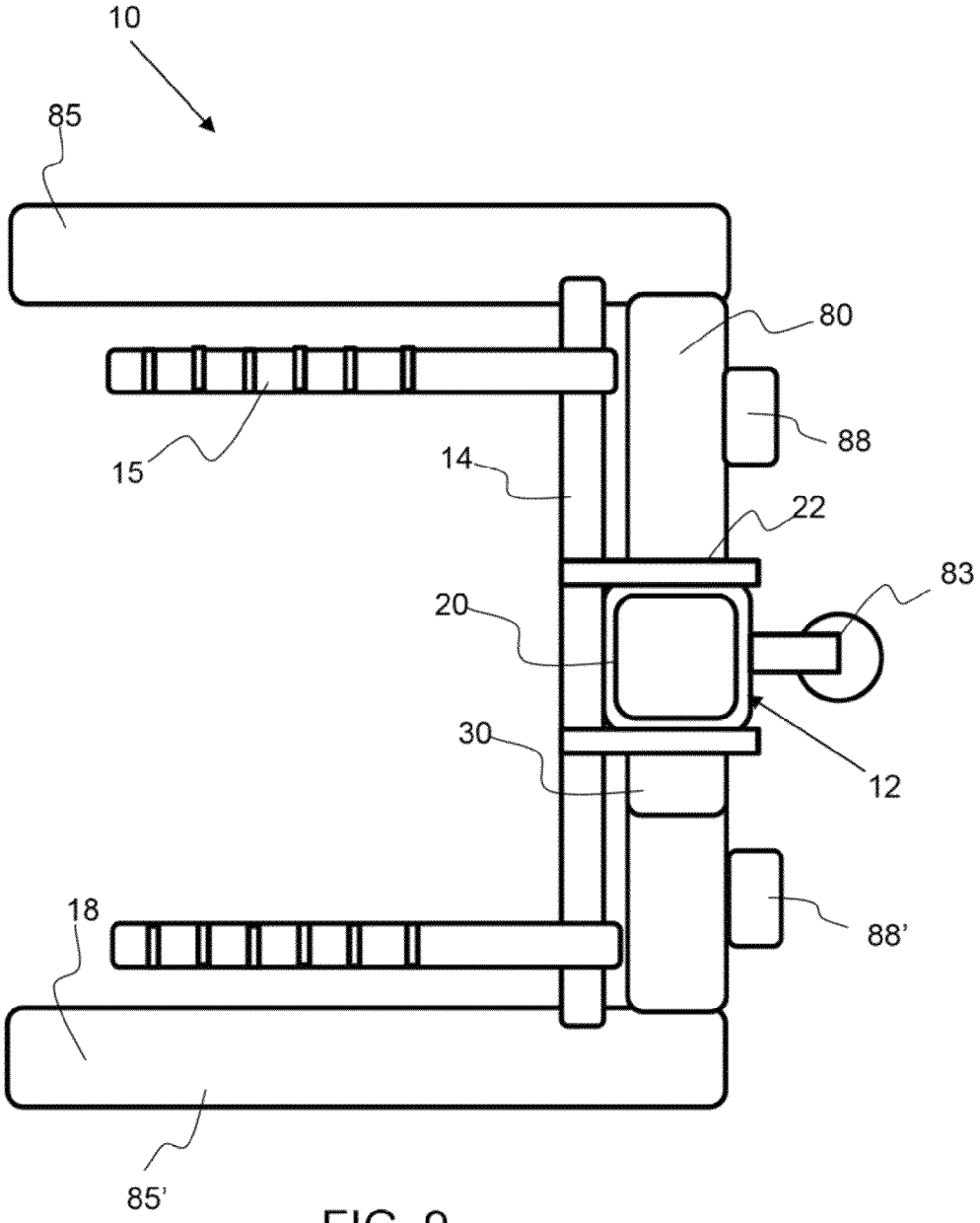

FIG. 9 shows a top-down view of an exemplary portable spotting device having two forward base portions extending from a horizontal base portion as described herein.

Figure 10:
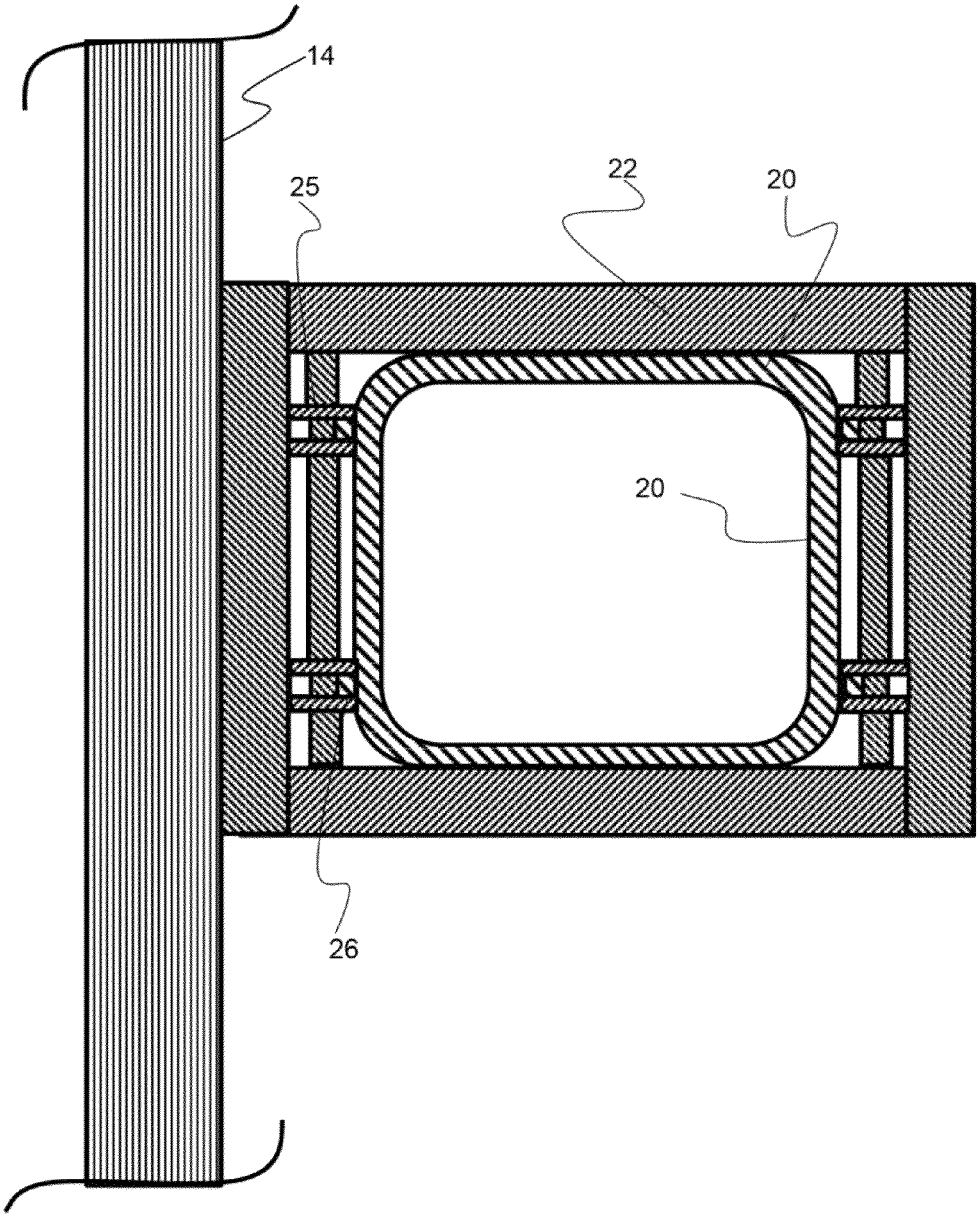

FIG. 10 shows a top-down view of an exemplary vertical support having rails and an actuator portion comprising guide wheels as described herein.

Figure 11:
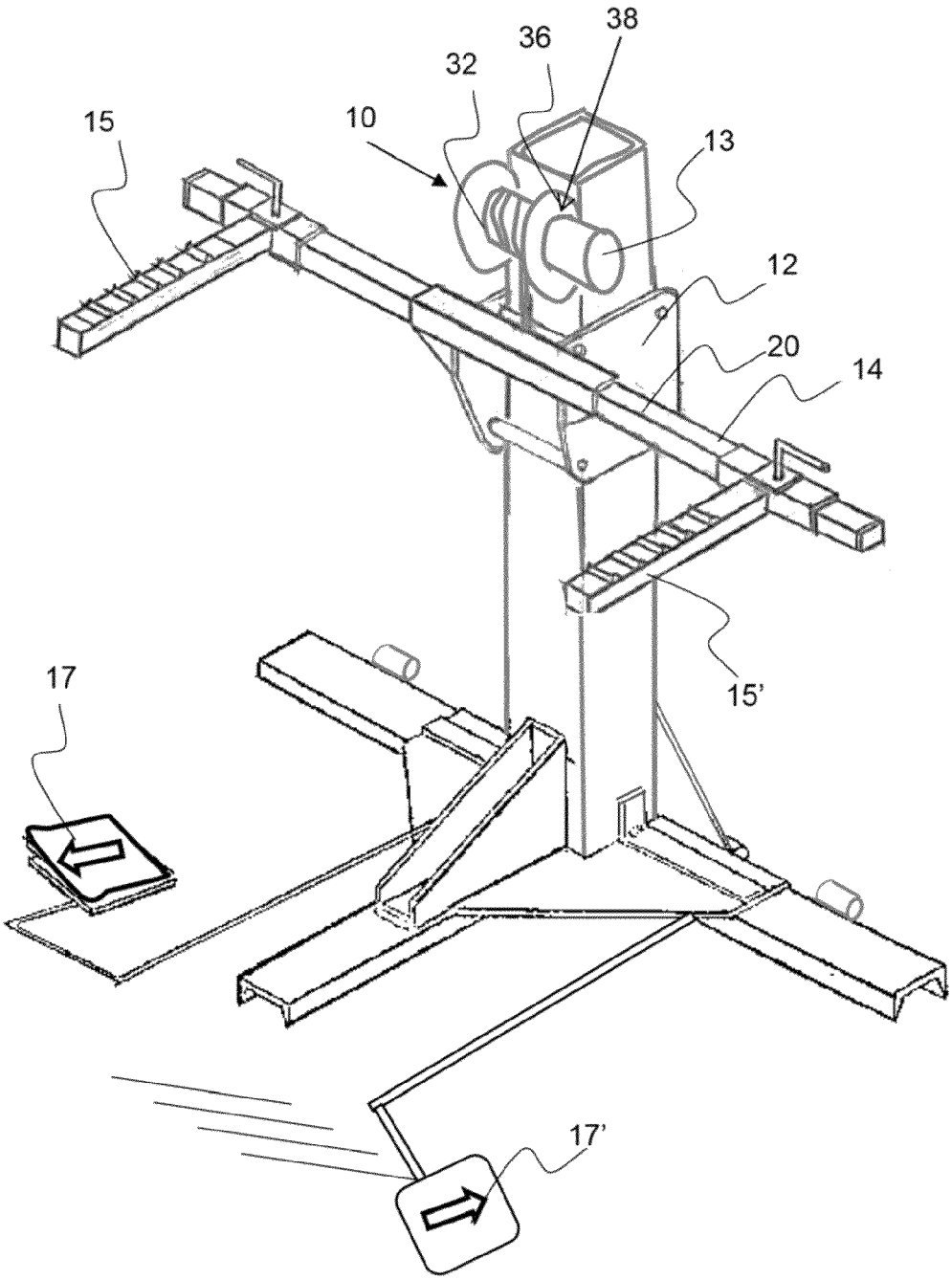

FIG. 11 shows an isometric view of an exemplary portable spotting device having the horizontal extension in an up position and the adjustable arms in a relatively wide configuration as described herein.

Figure 12:
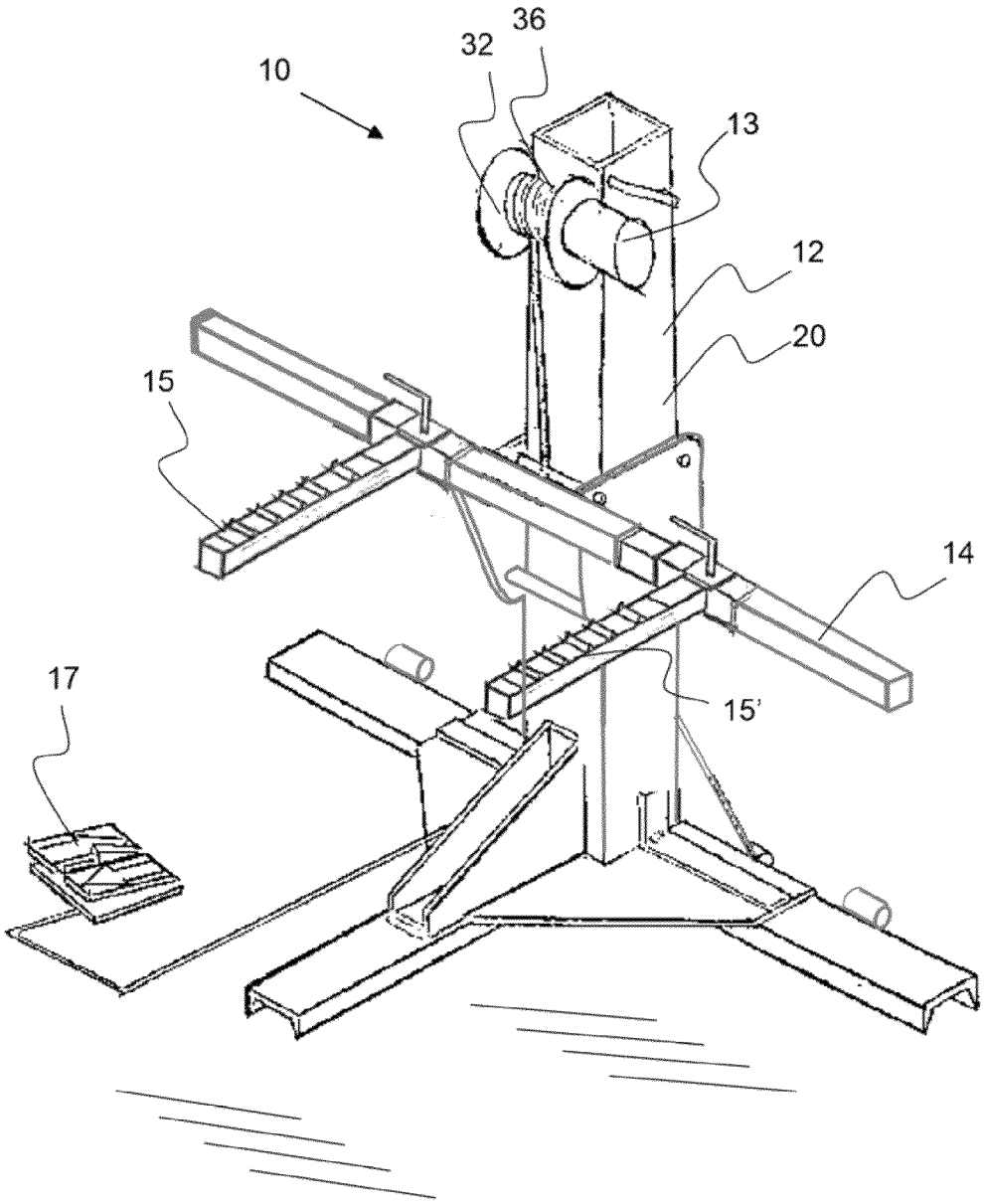

FIG. 12 shows an isometric view of an exemplary portable spotting device having the horizontal extension in a down position and the adjustable arms in a relatively narrow configuration as described herein.

Corresponding reference characters indicate corresponding parts throughout the several views of the figures. The figures illustrate some of the embodiments of the present invention and are not to be construed as limiting the scope of the invention in any manner. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the present invention.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Also, use of "a" or "an" are employed to describe elements and components described herein. This is done merely for convenience and to give a general sense of the scope of the invention. This description should be read to include one or at least one and the singular also includes the plural unless it is obvious that it is meant otherwise.

Certain exemplary embodiments of the present invention are described herein and illustrated in the accompanying figures. The embodiments described are only for purposes of illustrating the present invention and should not be interpreted as limiting the scope of the invention. Other embodiments of the invention, and certain modifications, combinations and improvements of the described embodiments will occur to those skilled in the art and all such alternate embodiments, combinations, modifications, improvements are within the scope of the present invention.

As shown in FIG. 1, the exemplary portable spotting device 10 has a powered lifting device 13 configured substantially at the top of the vertical support 20 as described herein. The powered lifting device is configured on the front side of the vertical support 20, and on the exterior of the vertical support. The cable 32 is wound around a spool and attached to the actuator portion 22. The horizontal extension 14 extends to either side of the vertical support and is centrally configured. A pair of adjustable arms 15, 15' are coupled to the horizontal extension on either side of the vertical support. The adjustable arms may be slid along the horizontal extension 14 and locked into place into any of the locking holes 44 configured in the horizontal extension. A locking device 54 is configured to extend into a locking hole and retain the adjustable arms in location along the horizontal extension. A locking device may be a peg, as shown, or a spring loaded post as is commonly used for adjustable features on exercise equipment. The adjustable arms 15, 15' comprise a plurality of stops 56 along the top surface of the adjustable arms for retaining a bar. A base 18 comprises a horizontal base portion 80 and extends to either side of the vertical support and a forward base portion that extends forward from the vertical support. It is to be understood that one or more forward base portions may be coupled with a horizontal base portion anywhere along the length of the horizontal base portion. An actuator pedal 17 is shown coupled with a pedal connector 70 to the powered lifting device. 13. In one embodiment, the vertical support acts as a central tower 12, to which all the elements of the portable spotting device are either directly or indirectly coupled.

As shown in FIG. 2, an exemplary portable spotting device 10 has a powered lifting device 13 configured substantially at the bottom of the vertical support 20 as described herein. The spool 36, cable 32 and pulley 34 are configured within the interior volume 21 of the vertical support member. The front side of the) vertical support is shown as open but it is to be understood that the front side of the vertical support may be dosed or at least partially closed for safety reasons. In one embodiment, one or more rubber elements are configured over the front side of the vertical support to prevent exposure to moving parts of the portable spotting device. In an exemplary embodiment, the entire motor, cable and/or pulley are configured with the interior volume of the vertical support, thereby preventing any exposure to those moving parts. As shown in FIG. 2, the powered lifting device 13, or electric motor 30, are configured substantially at the bottom of the vertical support and therefore may provide for easier tilting and moving of the spotting device from one location to another.

As shown in FIG. 3, an exemplary portable spotting device 10 is configured with a bench 90 to provide a weight bar 92 support and spotting means as described herein. A plurality of weights 94 are configured on either end of the weight bar 92. The weight bar is retained by the two adjustable arms 15, 15' and within the stops 56. As described, a weight lifter may use an actuator pedal to move the adjustable arms down to a desired location. In one embodiment a weight lifter may raise the adjustable arms up and lift the weight bar off the adjustable arms and forward to begin their bench press exercise. The weight lifter may lower the adjustable arms as they are conducting their bench press exercise in case they are unable to lift the weight up. In this event, the adjustable arms may be in a desired location to allow the weight lifter to simply place the bar on the adjustable arms and then use the actuator pedal to lift the weight bar up.

As shown in FIG. 4A, a horizontal extension 14 has two adjustable arms 15, 15' coupled thereto, as described herein. The length of the horizontal extension 40 is shown, whereby the adjustable arms may be adjusted along the length 40 as indicated by the double arrows. The horizontal length may be any suitable length including, but not limited to, greater than about 18 inches, greater than about 24 inches, greater than about 36 inches, greater than about 42 inches and any range between and including the length values provided. The adjustable arm length 50 is also shown in FIG. 4A and may be any suitable length including, but not limited to, greater than about 8 inches, greater than about 12 inches, greater than about 18 inches, greater than about 24 inches, greater than about 30 inches and any suitable range between and including the length values provided.)

As shown in FIG. 4B and FIG. 4C an exemplary adjustable arm 14 has a spring loaded stop 56 that is configured to, depress to allow a bar 92 to roll there over from one side. After the bar has rolled over the depressed stop, the stop pops-up and prevents the bar from rolling back. This type of stop may be particularly useful at the extended end of an adjustable arm to allow a weight lifter to place a bar onto the adjustable arm and roll it back over the spring loaded stop and not lift the weight over the stop.

As shown in FIG. 5, an adjustable arm 15 has a plurality of stops 56-56"", as described herein. The stops may have any suitable shape such as triangular as shown, rounded, rectangular and the like. The stops may be spaced apart any suitable distance such as no more than about 2 inches, no more than about 4 inches, no more than about 6 inches and the like. As shown in FIG. 5, the adjustable arm comprises an arm conduit 52, for insertion over the horizontal extension (not shown). A locking feature 54, such as a spring loaded locking feature, is configured over the conduit 52.

As shown in FIG. 6, an exemplary portable spotting device 10 has a plurality of wheels 88, 88' and 88" attached to the base as described herein. The portable spotting device 10 may rolled on the three wheels by first unlocking the locking features 89, 89' and 89". In another embodiment, the portable spotting device may be tilted, or rotated back, as indicated by the large arced arrow over the spotting device, whereby the spotting device may be rolled from one location to a second location by a single person. The portable spotting device may have any suitable number of wheels including, but not limited to, one, two, three, four, or more than four and any of the wheels may comprise a locking feature as is commonly used with cart wheels whereby a brake lever is pressed down to lock the wheel in place. A lever may also lift the wheels off the ground to prevent the portable spotting device from rolling when positioned in a desired location. Also shown in FIG. 6 is the actuator pedal 17 attached to the forward base portion 8 by a bracket.

As shown in FIG. 7 an exemplary portable spotting device 10 has a cantilevered wheel 83 and a wheel attached to the base 88 as described herein. The cantilevered wheel 83 and the wheel attached to the base will support the weight of the portable spotting device 10 only when tilted back. A track 26 is shown extending along a portion of the length of the vertical support 20. Guide wheels 25 configured on all four corners of the actuator portion 22 are shown in broken lines as) they are configured within the inside surface of the actuator portion. The vertical support 20 has a length 29 that may be any suitable length including, but not limited to, greater than about 30 inches, greater than about 36 inches, greater than about 42 inches, greater than about 48 inches, greater than about 60 inches and any range between and including the values provided. The vertical support may extend up to any suitable height from the floor or surface on which it is placed including, but not limited to, greater than about 30 inches, greater than about 36 inches, greater than about 42 inches, greater than about 48 inches, greater than about 60 inches and any range between and including the values provided.

As shown in FIG. 8, an actuator pedal 17, as described herein, has an up pedal 72, a down pedal 74 and a pedal connector 70. The pedal connector may be a physical connector, such as a connection cable, as shown, or it may comprise a wireless signal generator whereby the motor has a wireless signal receiver. The actuator pedal may be configured in any suitable location to provide easy manipulation by a weight lifter.

As shown in FIG. 9, an exemplary portable spotting device 10 has two forward base portions 85, 85' extending from a horizontal base 80 portion as described herein. The forward base portions are extending forward from the ends of the horizontal base portion but could be configured anywhere along the length of the horizontal base portion. The motor 30 is shown extending from the right side of the vertical member 20. A cantilevered wheel 83 is shown being extended from the back side of the vertical support. The cantilevered wheel may be spherical and allow for all degrees of rotation, thereby allowing a person to steer or guide the portable spotting device when transporting it from one location to another.

As shown in FIG. 10, an exemplary vertical support 20 has two rails 26 on the front side of the vertical support and two rails on the back side of the vertical support. Guide wheels 25 are configured to roll along the rails and provide for smooth motion of the actuator portion 22 up and down along the vertical support.

As shown in FIG. 11 an exemplary portable spotting device 10 has the horizontal extension 14 in an up position and the adjustable arms 15, 15' in a relatively wide configuration as described herein. The electric motor 13 is configure as a wench 38 whereby it drives the spool 36 having a cable 32 wound there around. Also shown in FIG. 11, are two actuator pedals 17, and 17'. One actuator pedal may move the actuating portion up and the other may move it down, as indicated by the) arrows. This may be easier for a weight lifter to engage, especially when a weight is stuck on their chest and they cannot lift it off.

As shown in FIG. 12 an exemplary portable spotting device 10 has the horizontal extension 14 in a down position and the adjustable arms 15, 15' in a relatively narrow configuration as described herein.

The portable spotting device as described herein may be a unitary device, whereby all of the components of the portable unitary device are connected and can be moved as a single one-piece unit. The actuator pedal may be coupled by an actuator coupler such as a cable and/or it may be connected by a bracket to a forward base, for example.

It will be apparent to those skilled in the art that various modifications, combinations and variations can be made in the present invention without departing from the spirit or scope of the invention. Specific embodiments, features and elements described herein may be modified, and/or combined in any suitable manner. Thus, it is intended that the present invention cover the modifications, combinations and variations of this invention provided they come within the scope of the appended claims and their equivalents.

What is claimed is:

1. A portable spotting device comprising:

a. a single central tower comprising:

i. a vertical support that extends up from a base;

ii. a powered lifting device attached to said vertical support; and iii. an actuator portion coupled to and configured to move up and down along said vertical support;

b. a horizontal extension having a length from a first extended end to a second extended end and substantially centrally coupled to said actuator portion;

wherein the horizontal support is only coupled to the single central tower portion and the first and second extended ends are unsupported;

whereby the horizontal extension is configured to move up and down along said vertical support;

c. a pair of adjustable arms attached to either side of the horizontal extension and extending from said horizontal extension in a substantially horizontal direction for supporting a weight bar and comprising:

i. a plurality of stops for securing the weight bar in a position;

wherein each of the adjustable arms has an arm length from the horizontal extension to an extended end of the adjustable arm an actuator pedal;

wherein the extended ends of the pair of adjustable arms is unsupported;

d. an actuator pedal;

e. a base; and f. a wheel coupled to said base;

wherein a cable is connected between said powered lifting device and said actuator portion, wherein the portable spotting device is portable whereby the spotting device can be moved by a single person by rolling said portable spotting device on said wheel, wherein the portable spotting device is not attached to any other piece of equipment, and wherein the adjustable arms can be moved and secured to the horizontal extension along the length of the horizontal extension.

2. The portable spotting device of claim 1, wherein the powered lifting device comprises an electric motor.

3. The portable spotting device of claim 1, wherein each of the adjustable arms comprises a conduit at one end that fits around the horizontal extension, whereby the adjustable arms are adjustable in position along the horizontal extension length.

4. The portable spotting device of claim 3, wherein the horizontal extension comprises a plurality of locking holes configured along the horizontal extension length, whereby a locking feature affixed to the adjustable arms is configured to secure the adjustable arms to the horizontal extension.

5. The portable spotting device of claim 1, wherein the powered lifting device is configured above the horizontal extension.

6. The portable spotting device of claim 1, wherein the powered lifting device is configured below the horizontal extension and wherein the cable is configured around at least one pulley configured above said horizontal extension.

7. The portable spotting device of claim 1, wherein the powered lifting device is configured substantially at the bottom of the vertical support.

8. The portable spotting device of claim 1, wherein the plurality of stops comprise raised elements configured along the adjustable arm length.

9. The portable spotting device of claim 1, comprising one or more spring loaded stops.

10. The portable spotting device of claim 1, wherein the base comprises a horizontal base portion.

11. The portable spotting device of claim 1, wherein the base comprises a horizontal base portion and a single forward portion that extends perpendicular to said horizontal base portion and extends forward from the central tower.

12. The portable spotting device of claim 1, wherein the wheel is attached to the horizontal base portion, whereby the portable spotting device can be tilted and rolled on said wheel.

13. The portable spotting device of claim 1, wherein the wheel has a locking feature.

14. The portable spotting device of claim 1, comprising a cantilevered wheel.

15. The portable spotting device of claim 1, wherein the actuator pedal comprises an up pedal.

16. The portable spotting device of claim 1, wherein the actuator pedal comprises an up pedal and a down pedal.

17. A portable spotting device comprising:

a. a single central tower comprising:

i. a vertical support that extends up from a base;

ii. a powered lifting device comprising an electric motor attached to said vertical support;

iii. an actuator portion coupled to and configured to move up and down along said vertical support;

b. a horizontal extension having a length from a first extended end to a second extended end and substantially centrally coupled to said actuator portion;

wherein the horizontal support is only coupled to the single central tower portion and the first and second extended ends are unsupported;

whereby the horizontal extension is configured to move up and down along said vertical support;

c. a pair of adjustable arms attached to either side of the horizontal extension and extending from said horizontal extension in a substantially horizontal direction for supporting a weight bar and comprising:

i. a plurality of stops for securing the weight bar in a position;

wherein each of the adjustable arms has an arm length from the horizontal extension to an extended end of the adjustable arm an actuator pedal;

wherein the extended ends of the pair of adjustable arms is unsupported;

wherein each of the adjustable arms comprises a conduit at one end that fits around the horizontal extension, whereby the adjustable arms are adjustable in position along the horizontal extension length;

wherein the horizontal extension comprises a plurality of locking holes configured along the horizontal extension length, whereby a locking feature affixed to the adjustable arms is configured to secure the adjustable arms to the horizontal extension; and d. a wheels coupled to said base;

wherein the motor is coupled with a spool, wherein the powered lifting device is configured above the horizontal extension, wherein a cable is connected between said spool and said actuator portion, wherein the portable spotting device is not attached to any other piece of equipment, wherein the adjustable arms can be moved and secured to the horizontal extension along the length of the horizontal extension, wherein the wheel is attached to the base horizontal portion, whereby the portable spotting device is portable whereby it can be tilted and rolled on said wheel by a single person.

18. The portable spotting device of claim 17, wherein the base comprises a. a horizontal base portion; and b. a single forward base portion that is substantially aligned with the central tower and extends forward therefrom.

19. The portable spotting device of claim 17, wherein the wheel comprise a locking feature.

20. The portable spotting device of claim 17, further comprising a spring loaded stop at the extended end of at least one of the adjustable arms.

* * * * *